United States Patent [19]

Tronetti, Jr.

[11] Patent Number: 4,936,162

[45] Date of Patent: Jun. 26, 1990

[54] ADJUSTMENT SCREW ARRANGEMENT

[76] Inventor: Peter J. Tronetti, Jr., 101 Chippewa St., Royal Oak, Mich. 48073

[21] Appl. No.: 379,032

[22] Filed: Jul. 10, 1989

[51] Int. Cl.[5] ..... G05G 1/10

[52] U.S. Cl. ..... 74/553; 16/121; 16/DIG. 30

[58] Field of Search ..... 74/553, 545, 527, 531, 74/10.41, 10.35; 16/121, 122, DIG. 24, DIG. 30; 200/290, 291, 323, 325; 251/292, 291; 403/289, 165

[56] References Cited

U.S. PATENT DOCUMENTS

| | | | |
|---|---|---|---|
| 2,797,591 | 7/1957 | Marrapese | 74/553 X |
| 2,797,592 | 7/1957 | Marrapese | 74/553 X |
| 3,662,618 | 5/1972 | Kroll et al. | 74/527 |
| 4,565,350 | 1/1986 | Rozek | 74/553 X |
| 4,593,430 | 6/1986 | Spangler et al. | 16/121 |
| 4,779,305 | 10/1988 | Gorsek | 16/DIG. 30 X |
| 4,821,597 | 4/1989 | Marciniak et al. | 74/545 |

FOREIGN PATENT DOCUMENTS

| | | | |
|---|---|---|---|
| 1045882 | 10/1966 | United Kingdom | 16/121 |
| 2109535 | 6/1983 | United Kingdom | 74/553 |

*Primary Examiner*—Vinh T. Luong

*Attorney, Agent, or Firm*—Peter A. Taucher; David L. Kuhn

[57] ABSTRACT

A mechanism to prevent a dial or knob of an instrument panel from wandering from a manual setting when the panel is subjected to severe vibrations. The mechanism includes a compression spring to place a load on the dial in the direction of the dial's rotational axis. The mechanism also has a pair of roothed, interdigitated sleeves rotatably disposed along the axis to prevent torque transfer between the dial and the spring.

6 Claims, 4 Drawing Sheets

ADJUSTMENT SCREW ARRANGEMENT

GOVERNMENT INTEREST

The invention described herein may be manufactured, used and licensed by or for the U.S. Government for governmental purposes without payment to me of any royalty thereon.

BACKGROUND AND SUMMARY

Modern military vehicles carry an increasing number of electronic components designed, inter alia, to find possible targets, detect and counter enemy attempts to locate and identify the vehicle, and to manage performance of the vehicle. Such vehicles typically carry a number of instruments whose control panels contain manually adjustable dials or knobs rotatable upon shafts threaded to openings in the panel, and it is often critical that these dials or knobs are prevented from wandering even slightly from their settings. The vehicles and their components are subjected to severe vibrations and consequently a spring is commonly compressed between a collar on the threaded shaft and the face of the panel. The spring axially forces together the complimentary threads of the shaft and panel, thereby inhibiting the turning of the knobs or dials by the vibrations. In many cases, however, the nature and intensity of the vibrations is such that a spring alone may not suffice to prevent dial movement, particularly when a vehicle vibration sets up a harmonic vibration in the spring. Unwanted dial movement may also occur, if the spring-/dial assembly is vibrated in two directions at once, so that one vibration bends the spring along its central axis as another vibration moves shaft threads relative to panel opening threads within a typical interthread clearance.

My invention is an arrangement wherein the dial is prevented from rotating even under the severe vibrational conditions described above. The invention is a pair of interdigitated sleeves rotatable on the axis of the dial shaft. The sleeves encage a coil spring which inhibits rotation of the shaft in a known manner relative to a substrate or body into which the shaft is threaded. My invention can not only be used on electronic instruments as described above, but can also be used on set screw arrangements and screw type metering valves for precise control of a fluid under intense vibrational conditions.

DETAILED DESCRIPTION

Figure 1:
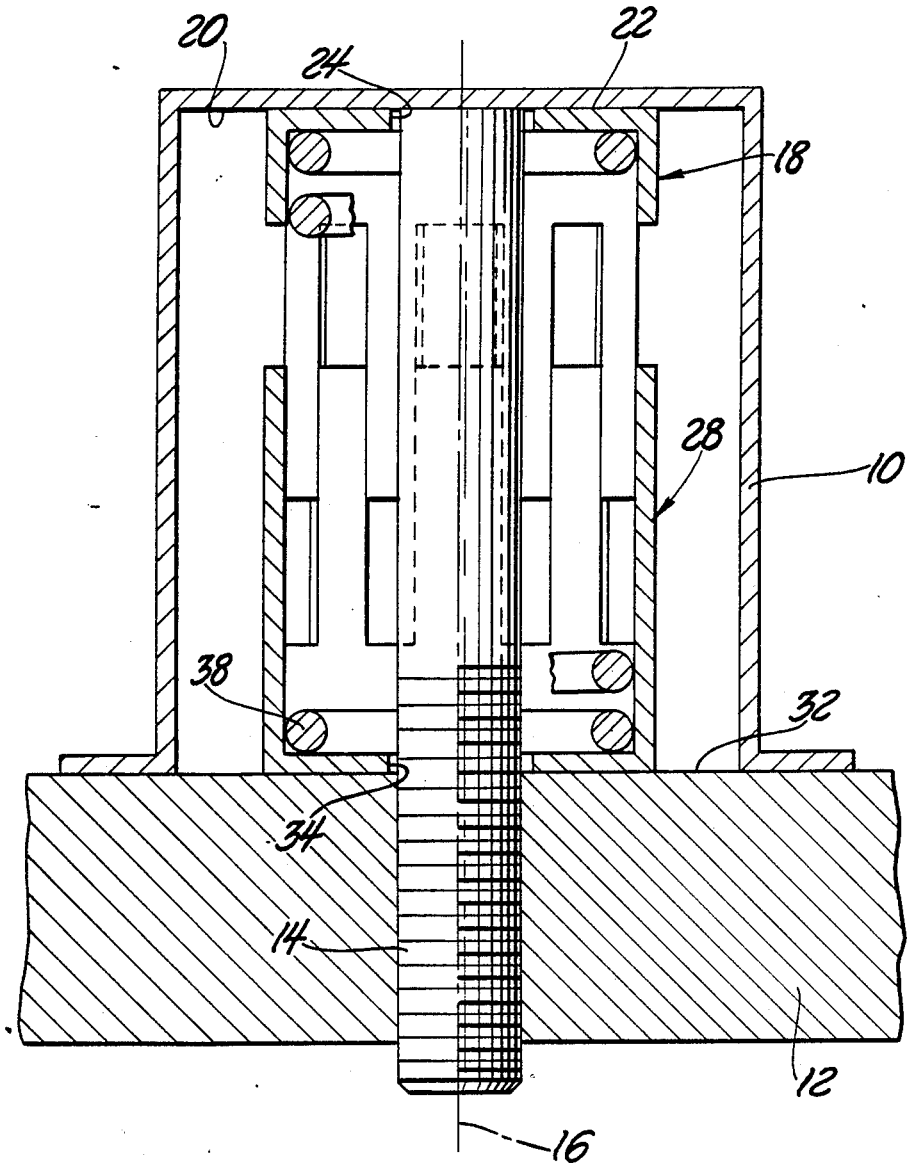
FIG. 1 is a sectional view of my invention as applied to a control knob or dial fixed to a partially threaded shaft, the shaft not being sectioned in the figure.
Figure 2:
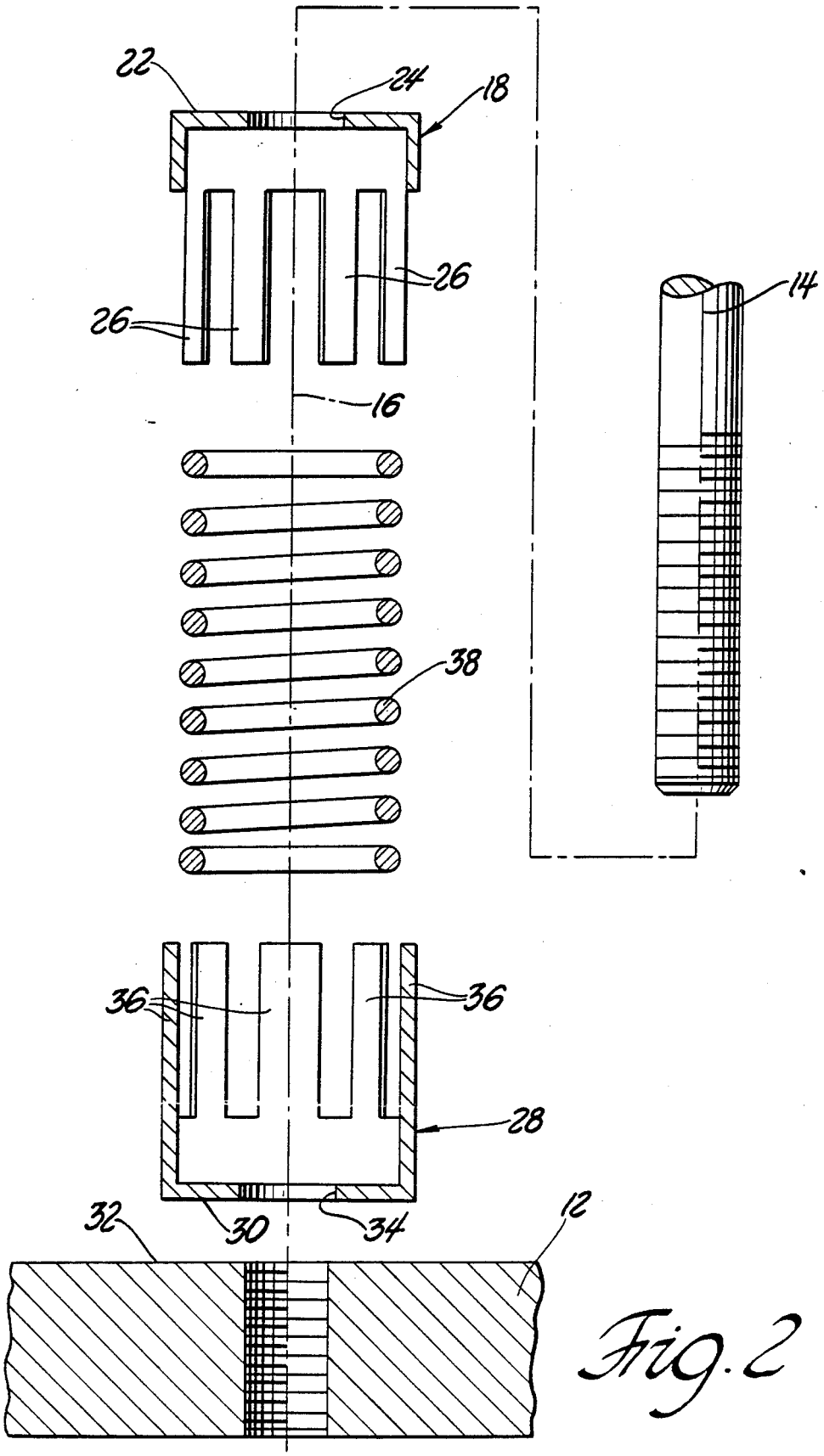
FIG. 2 is an exploded view of FIG. 1.

In FIGS. 1 and 2 there is shown a generally cylindrical hollow control knob 10 disposed on the external wall 12 of an electrical panel. Shown unsectioned in the Figures is a knob shaft 14 coaxially attached to knob 10 and threadingly received in wall 12. Rotatable on shaft 14 about common axis 16 and extending along this axis is a sleeve 18 which rotatingly bears against an inner peripheral surface 20 that is parallel to wall 12. Bearing surface 22 of sleeve 18 may have a TEFLON material or other low friction material used as a coating to minimize the torsional forces that will be transferred between sleeve 18 and knob 10 when knob 10 is manually rotated on axis 16. Sleeve 18 has an axial opening 24 for accommodating shaft 14, the opening preferably being slightly diametrically larger than the shaft so that the shaft turns freely in opening 24, and so that little or no torque is transferred between shaft 14 and sleeve 18. Additionally, the sides of opening 24 can be coated with a low friction material to further insure that essentially no torque is transferred between shaft 14 and sleeve 18. Sleeve 18 has a series of elongate teeth 26 (FIG. 2) extending parallel to axis 16 and extending away from bearing surface 20, the teeth preferably having angular or arcuate widths that are equal to each other and equal to the angular width of circumferential gaps between the teeth.

A second sleeve 28 has a configuration that is preferably the same as sleeve 18, sleeve 28 also being rotatable about common axis 16 on shaft 14. Sleeve 28 has an axially oriented bearing surface 30 (FIG. 2) which slidingly rotates upon a flat bearing surface 32, bearing surface 32 preferably having a low friction coating so that sleeve 28 will rotate freely on mounting surface 32. Opening 34 in sleeve 28 is slightly larger in diameter than shaft 14 and the sides of opening 34 is also preferably coated with a low friction material so that shaft 14 and collar 28 can rotate independently of one another about common axis 16 without a transfer of torque therebetween. Teeth 36 (FIG. 2) of sleeve 28 are equal in arcuate width to one another, to the circumferential gaps alternated with teeth 36 and to the angular width of teeth 26 on sleeve 18 so that teeth of the respective sleeves will fit in close interdigitated relation when the sleeves move together.

When sleeves 18 and 28 are moved together and their respective teeth are interdigitaled, the sleeves form a cage-like or capsule-like enclosure which contains and protects compression coil spring 38. Spring 38 and the sleeves are of the same metal or are of metals which are close together in the electromotive series so that there is no appreciable corrosion of the spring and therefore no reduction of its spring rate over long periods of time. Spring 38 will be under a selected range of axial compressive loads in the typical arrangement shown in FIG. 1, and the inner diameter of the sleeves will be sized so that the spring will not bind against the inner peripheral walls of the sleeves when the spring is within the selected range of axial loading. The inner diameter of the sleeve is preferably equal to the particular diameter to which the spring expands when the largest acceptable compressive load is on the spring. It is preferred that inner diameter of the sleeves be no greater than the aforementioned particular spring diameter so that the spring is given minimum ability to bend relative to its own axis.

The range of axial compressive loads on spring 38 will vary from design to design, but the minimum value for the range will be the axial force needed to reliably keep knob 10 in a selected rotational position on the face of a control panel. The maximum compressive force will be the greatest force with which the spring can be loaded without damaging threads on shaft 14 or damaging the complimentary threads in wall 12, or making it too difficult to turn knob 12 manually. It may be preferred that the two sleeves will completely mesh together just before the maximum value of the compression upon spring 38 would be reached, so that there are no axial gaps in the fit between the two sets of teeth. This latter feature has two advantages. First, the cage or capsule formed by the sleeves will be completely closed, or nearly so, in the preferred, operational compression range of the spring whereby the spring receives some protection from dust, dirt or foreign matter. Second, there will be a sudden increase in torque necessary to turn knob 10 as the maximum preferred compression for spring 38 is approached, so that a human operator turning the knob will have a palpable feedback just before this maximum value is reached, whereby the operator is warned to turn the knob no further.

Figure 3:
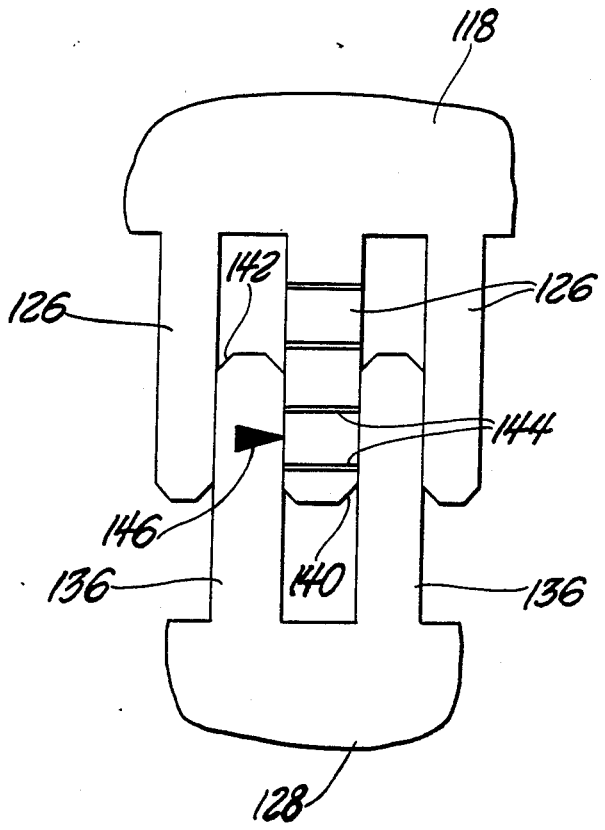
FIG. 3 shows a modified tooth design for sleeves that form part of my invention.

FIG. 3 shows a detail view of meshed teeth on sleeves 118 and 128 similar to sleeves 18 and 28 in FIGS. 1 and 2, except that teeth 126 and 136 in FIG. 3 are different from teeth 26 and 36 in FIGS. 1 and 2. Teeth 126 and 136 have bevels as at 140 and 142 which guide these teeth into interdigitated engagement when sleeves 118 and 128 are closed together. In addition, one of teeth 126 has a set of equally spaced graduation or scale marks as seen at 144 and one of teeth 136 has an indicator such as arrowhead 146, the relative positions of the arrowhead and graduation marks providing an indication of the axial compression on spring 38 contained by sleeves 118 and 128. Marks 144 may be numbered, labelled or color coded to increase the ease with which the human operator can equate the marks with corresponding sets of values for compression of spring 38.

Figure 4:
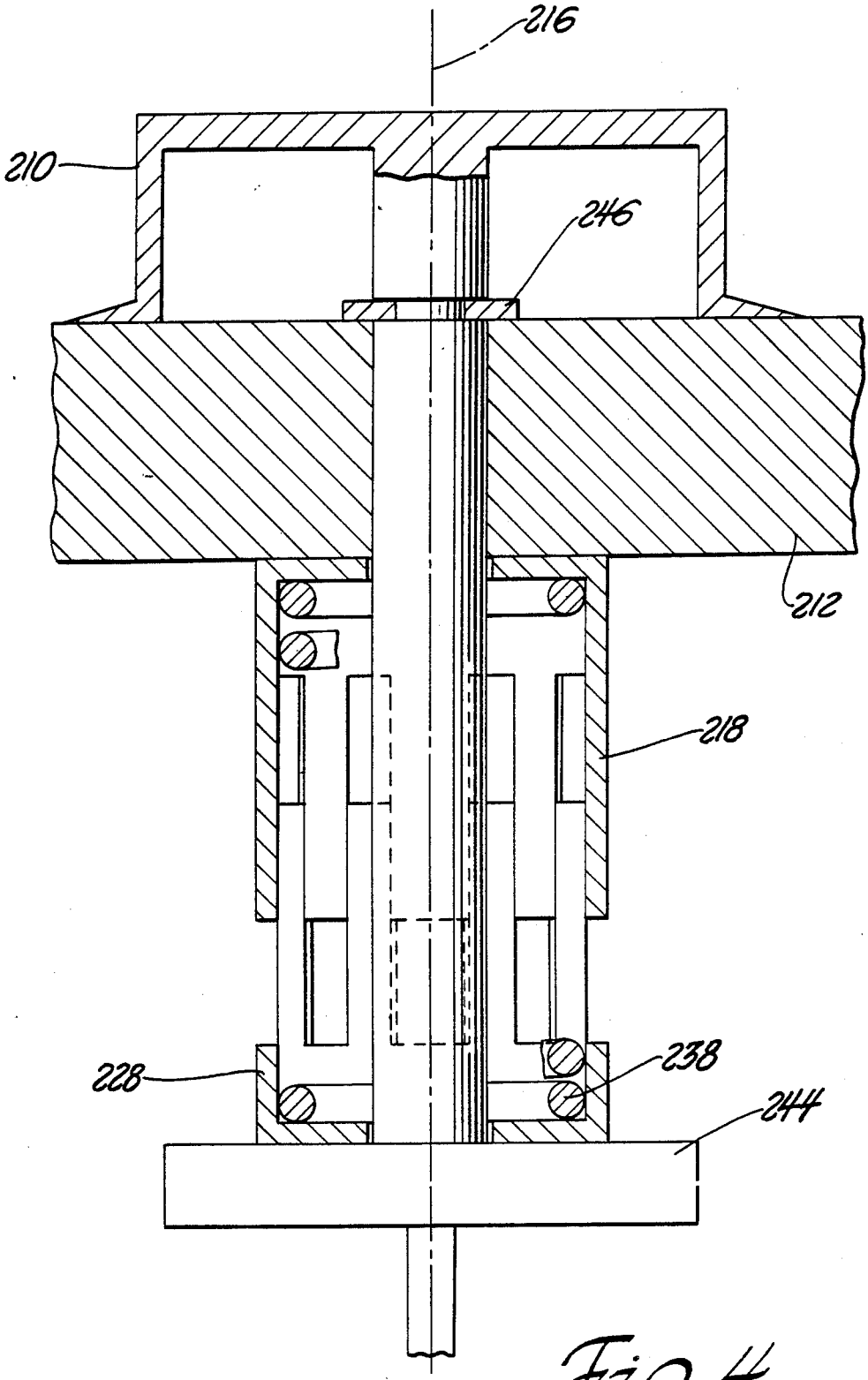
FIG. 4 shows an alternate embodiment of my invention.

FIG. 4 shows an alternate embodiment of my invention wherein sleeves 218 and 228 are the same as those shown in FIGS. 1 and 2, and spring 238 is the same as spring 38 in those figures. Shaft 214 is an unthreaded shaft having a retention collar 244 to trap the assembly of sleeve 218, sleeve 228 and spring 238 against the interior of wall 212 of an instrument panel. Dial 210 rotatingly bears against the exterior of wall 212, the axial load of dial 210 toward wall 212 being born up by bearing or bushing 246.

I wish it to be understood that I do not desire to be limited to the exact details of construction shown and described herein since obvious modifications will occur to those skilled in the art without departing from the spirit and scope of the appended claims.

I claim:

1. A control mechanism wherein the angular position of a rotatable shaft mounted to a wall is used to control a selected output, the rotational position of the shaft being infinitely variable within a selected range of angular movement, the control mechanism having an improved anti-rotation means to inhibit rotation of the shaft by vibrations to which the control mechanism is subjected, the control mechanism comprising:

a flat mounting surface on the wall perpendicular to a rotational axis of the shaft, the wall having an opening at the mounting surface through which the shaft extends;

means for permitting rotation of the shaft by a human hand, the permitting means having a flat opposing surface faced toward and parallel with the mounting surface;

a first cylindrical sleeve rotatable about the axis of the shaft, one end of the first sleeve having a smooth, flat, axially oriented face rotatably and slidingly bearing against the opposing surface of the permitting means, the axially oriented face having a hole therethrough whose diameter is larger than that of the shaft so that the hole essentially frictionlessly accommodates angular and axial movement therein of the shaft;

elongate, axially extending first teeth in a circular array on another end of the first sleeve, the first teeth being of equal angular width and being circumferentially spaced at distances equal to the angular width;

a second cylindrical sleeve rotatable about the axis of the shaft, one end of the second sleeve having a smooth, flat, axially oriented surface rotatably and slidingly bearing against the mounting surface, the axially oriented surface having an aperture therethrough whose diameter is larger than that of the shaft so that the aperture essentially frictionlessly accommodates angular and axial movement therein of the shaft;

elongate, axially extending second teeth in a circular array on another end of the second sleeve, the second teeth being of the equal angular width and being circumferentially spaced at distances equal to the angular width;

the sleeves axially translatable toward one another so that the first and second teeth closely mesh whereby the sleeves together form a capsule-like enclosure;

a compression coil spring within the enclosure biasing the sleeves away from one another and keeping the permitting means and the wall apart, the spring having an inner diameter larger than the diameter of the shaft; the spring having an outer diameter equal to the inner diameter of the sleeves when the spring is subjected to a given compression force, the spring and the sleeves being elements of the anti-rotation means;

means positioned at the opening of the wall and connected with the shaft for limiting the distance by which the permitting means and the wall are kept apart at any given angular position of the shaft.

2. The mechanism of claim 1 wherein the limiting means is comprised of complimentary threads on the shaft and in the opening, there being axial play between the complimentary threads.

3. The control mechanism of claim 2 wherein there is a preselected compressive force which is a maximum compressive force to which the spring is to be subjected;

wherein the first teeth and the second teeth are closed together completely at the preselected compressive force so the sleeves axially abut, whereby the sleeves are under axial compression at the preselected compressive force and a human operator manipulating the permitting means perceives an accelerated increase in force necessary to continue turning the shaft so as to further compress not only the spring, but also the sleeves.

4. The control mechanism of claim 1 wherein the spring and the sleeves are made of metals close to one another in an electromotive series.

5. The control device of claim 1 wherein one tooth on one sleeve has axially spaced graduations to form a scale thereon and an adjacent tooth on another sleeve has an indicator mark thereon, the axial juxtaposition of the mark with the scale being an indication of the compressive force on the spring.

6. The mechanism of claim 1 wherein the distance between the inner diameter of the sleeves and the outer diameter of the springs is less than the distance between the inner diameter of the spring and the shaft, whereby the spring does not contact the shaft.

* * * * *